US006698597B2

(12) United States Patent
Marihugh

(10) Patent No.: US 6,698,597 B2
(45) Date of Patent: Mar. 2, 2004

(54) VERTICAL MERCHANDISE DISPLAY UNIT

(75) Inventor: Daniel W. Marihugh, Chicago, IL (US)

(73) Assignee: Sears Brands, LLC, Hoffman Estates, IL (US)

( * ) Notice: Subject to any disclaimer, the term of this patent is extended or adjusted under 35 U.S.C. 154(b) by 0 days.

(21) Appl. No.: 09/833,316

(22) Filed: Apr. 12, 2001

(65) Prior Publication Data

US 2002/0148792 A1 Oct. 17, 2002

(51) Int. Cl.[7] ..... A47F 7/00
(52) U.S. Cl. ..... 211/26; 211/133.1
(58) Field of Search ..... 211/26, 26.2, 133.1, 211/133.4; D6/397, 460, 461, 474; D20/41; 312/209, 223.3

(56) References Cited

U.S. PATENT DOCUMENTS 1,237,014 A * 8/1917 Botty et al. ..... 131/240.1
D188,855 S * 9/1960 Reineman et al. ..... D6/397
D190,916 S * 7/1961 Fischer ..... D6/397
D190,917 S * 7/1961 Fischer ..... D6/397
D206,509 S * 12/1966 Kimler ..... D6/460
3,450,454 A 6/1969 Anders ..... 312/223
D225,708 S * 1/1973 Alippe et al. ..... D6/461
3,763,709 A * 10/1973 Eynon et al. ..... 74/5.47
D234,631 S * 3/1975 Erik et al. ..... D16/228
3,940,136 A * 2/1976 Runte ..... 194/350
3,942,647 A 3/1976 Crosslen ..... 211/144
3,976,837 A * 8/1976 Lang ..... 348/832
4,084,194 A * 4/1978 Hector ..... 348/840
4,416,293 A * 11/1983 Anderson et al. ..... 348/77
4,475,322 A * 10/1984 Russo et al. ..... 52/27
4,607,897 A * 8/1986 Schwartz ..... 312/209
5,124,685 A 6/1992 Rankin ..... 340/568
5,184,601 A * 2/1993 Putman ..... 600/102
5,186,337 A * 2/1993 Foster et al. ..... 211/26
D340,049 S * 10/1993 Liljenwall et al. ..... D14/371
D344,505 S * 2/1994 Traldi ..... D14/373
5,284,255 A * 2/1994 Foster et al. ..... 211/26
5,421,667 A * 6/1995 Leyden et al. ..... 248/551
5,440,396 A * 8/1995 Markus et al. ..... 356/394
5,618,090 A * 4/1997 Montague et al. ..... 312/209
5,630,566 A * 5/1997 Case ..... 248/122.1
D380,011 S * 6/1997 Pettus ..... D20/10
5,663,746 A * 9/1997 Pellenberg et al. ..... 211/70
D393,382 S * 4/1998 Rutter et al. ..... D6/474
5,738,316 A * 4/1998 Sweere et al. ..... 248/123.11
5,746,334 A 5/1998 Brandenberg ..... 211/205
5,806,943 A * 9/1998 Dell et al. ..... 312/223.3
5,820,623 A * 10/1998 Ng ..... 318/568.11
5,857,415 A * 1/1999 Richard ..... 108/10
5,906,284 A 5/1999 Hammerstrom et al. .... 211/205
D412,719 S * 8/1999 Leeds ..... D20/41
D412,720 S * 8/1999 Leeds ..... D20/41
5,971,268 A * 10/1999 Lynch et al. ..... 235/1 R
5,986,576 A * 11/1999 Armstrong ..... 340/908
5,992,788 A * 11/1999 Glass ..... 242/400.1
6,027,277 A * 2/2000 Leyden et al. ..... 248/179.1
6,128,143 A * 10/2000 Nalwa ..... 359/725
6,375,370 B1 * 4/2002 Wesselink et al. ..... 396/427
6,380,909 B1 * 4/2002 Wilkinson et al. ..... 343/890
6,386,906 B1 * 5/2002 Burke ..... 439/501
6,389,992 B1 * 5/2002 Miller ..... 108/102
6,473,118 B1 * 10/2002 Morrow ..... 348/143

* cited by examiner

*Primary Examiner*—Alvin Chin-Shue
*Assistant Examiner*—Khoa Tran
(74) *Attorney, Agent, or Firm*—Michael Best & Friedrich LLP

(57) ABSTRACT

In order to provide an improved device for displaying a product in a retail environment, a vertical merchandise display unit includes a base, a riser, a monitor, and product support arms. The riser extends generally vertically upwardly from the base and the monitor is supported by the riser above the product support arms. Further, the unit includes a plurality of product support arms which extend radially outwardly from the riser at a point above the base for displaying products such as digital cameras, camcorders and the like.

24 Claims, 6 Drawing Sheets

VERTICAL MERCHANDISE DISPLAY UNIT

FIELD OF THE INVENTION

The present invention relates to retail store fixtures and, more particularly, a vertical merchandise display unit for digital cameras, camcorders and the like.

BACKGROUND OF THE INVENTION

In the retail store environment, it has been recognized that there is a need for improved fixtures that achieve a number of important objectives. For instance, the space which is available in a retail store must be utilized in a highly effective manner since many retail businesses display more consumer products than ever before. Since the cost of space is critical, it is also important to maximize the return that can be generated from the products that are displayed in a given space.

In addition, the manner in which products are displayed is known to have a significant impact on the ability to sell them in a retail store. Thus, if products are displayed in a user-friendly and attractive manner, it is far more likely that sales of products generated from such a display will be far greater than might otherwise be expected. However, with conventional retail store fixtures, there is little that can be accurately characterized as user-friendly or attractive merchandising.

While the foregoing holds true for sales of particular products, there is also the issue of enhancing the overall attractiveness of the retail shopping experience to consumers that frequent the stores. Competition at the retail level is greater than ever before and, thus, retailers must present an attractive shopping environment and enjoyable shopping experience in order to sell to consumers who enter their stores and encourage those same consumers to make frequent repeat visits. If a retail store has outmoded fixtures that are neither user-friendly nor attractive, it is far more likely that sales will lag and consumers will not return opting instead for on-line shopping.

With regard to certain electronic products, the profit margins tend to be higher and consumer interest is easily generated. This is particularly true in videography, i.e., the items that tell the story of our lives such as digital cameras, camcorders and the like. Currently, digital cameras and camcorders are presented in a linear display that takes an inordinate amount of retail floor space.

By way of example, a typical display of camcorders can be on the order of 14 feet wide by 2 feet deep thereby taking up 28 square feet. This type of display frequently includes a separate monitor for each camcorder which is continuously on to show the images of customers passing by. As will be appreciated, this is extremely costly both in terms of the use of space and the provision of so many monitors.

In addition to the foregoing drawbacks, the typical linear display of camcorders simply has little to offer in the way of drawing attention to consumers who are passing through the retail store.

In view of the foregoing, there has remained a need for improvements for displaying retail products, particularly digital cameras and camcorders, in a user-friendly and attractive fashion that captures the attention of the consumer in a manner that also encourages repeat visits to the store.

SUMMARY OF THE INVENTION

Accordingly, the present invention is directed to a vertical merchandise display unit comprising a base, a riser, a monitor, and a plurality of product support arms. The riser extends generally vertically upwardly from the base and the monitor is supported by the riser so as to be positioned above the product support arms. With this arrangement, the product support arms extend radially outwardly from the riser above the base to support products such as digital cameras and camcorders.

In a preferred embodiment, the base is generally circular in cross-section and generally cylindrical in shape to have a radial footprint generally commensurate with the radially outwardly extending arms. The base advantageously comprises a storage compartment for operating equipment related to products to be supported on the arms. Still additionally, the riser preferably comprises a hollow pole which is mounted to the base to provide a chase through which wiring can extend from the base to the product support arms and the monitor.

Advantageously, the hollow pole has a plurality of flat surfaces for securing the product support arms thereto and has an upper end supporting a monitor pod having the monitor disposed therewithin. The product support arms preferably have at least one generally horizontal product supporting surface for displaying at least one product thereon. In a preferred embodiment, the product support arms each comprise a separate hollow pod having a generally inverted pyramidal shape and the product supporting surfaces are positioned at more than one distance above the base.

In a highly preferred embodiment, the base which defines the storage compartment permits the use of operating equipment related to the products so that a potential purchaser can view product marketing information and also personally operate the product. Further, each of the product support arms advantageously includes a pair of generally horizontal surfaces for displaying digital cameras at a first level adjacent the hollow pole and at a second, lower level radially outwardly of the hollow pole. Still additionally, alternating ones of the product support arms preferably include generally horizontal surfaces for displaying camcorders at a first level adjacent the hollow pole and at a second, lower level radially outwardly of the hollow pole.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
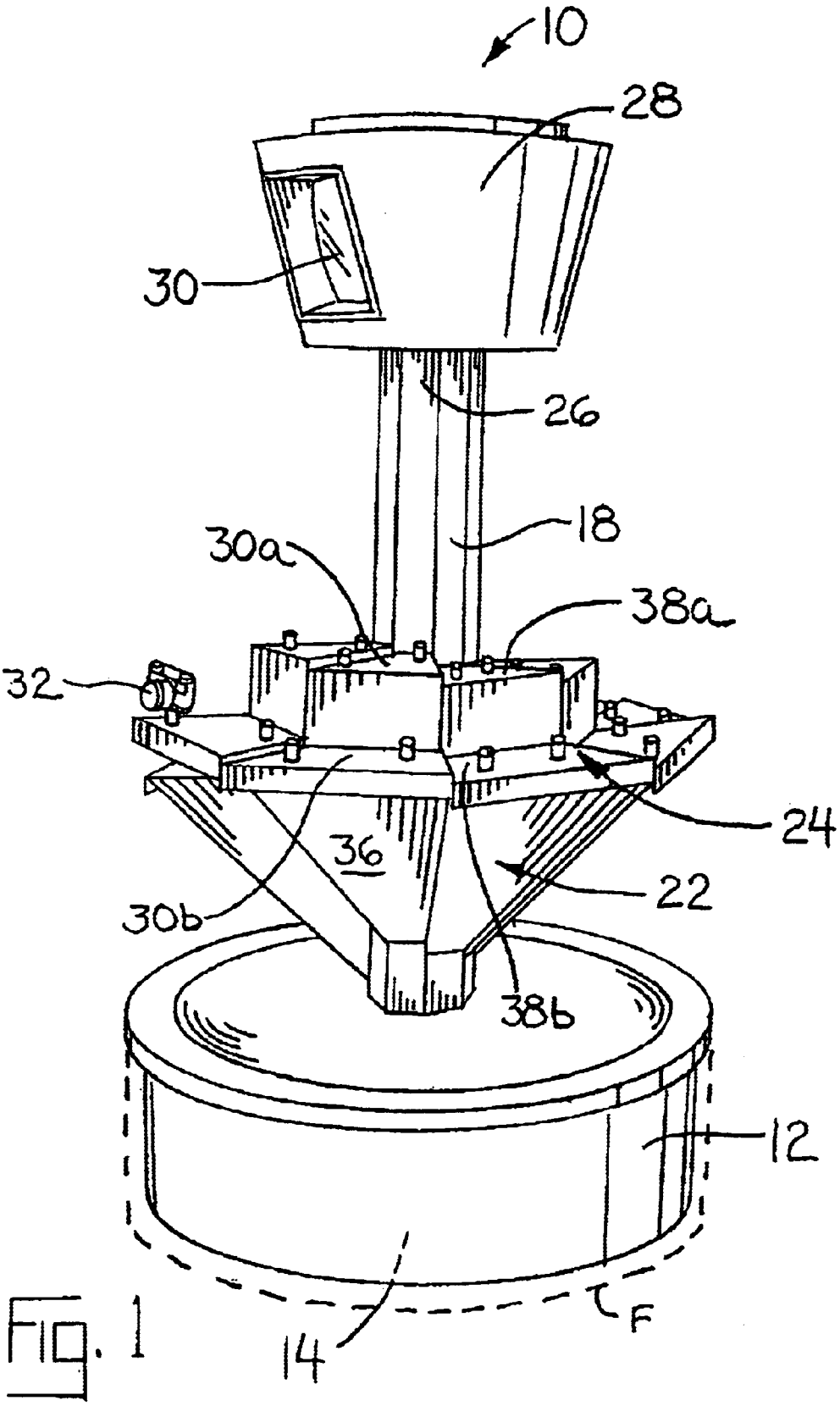
FIG. 1 is a perspective view of a vertical merchandise display unit for digital cameras in accordance with the present invention.
Figure 2:
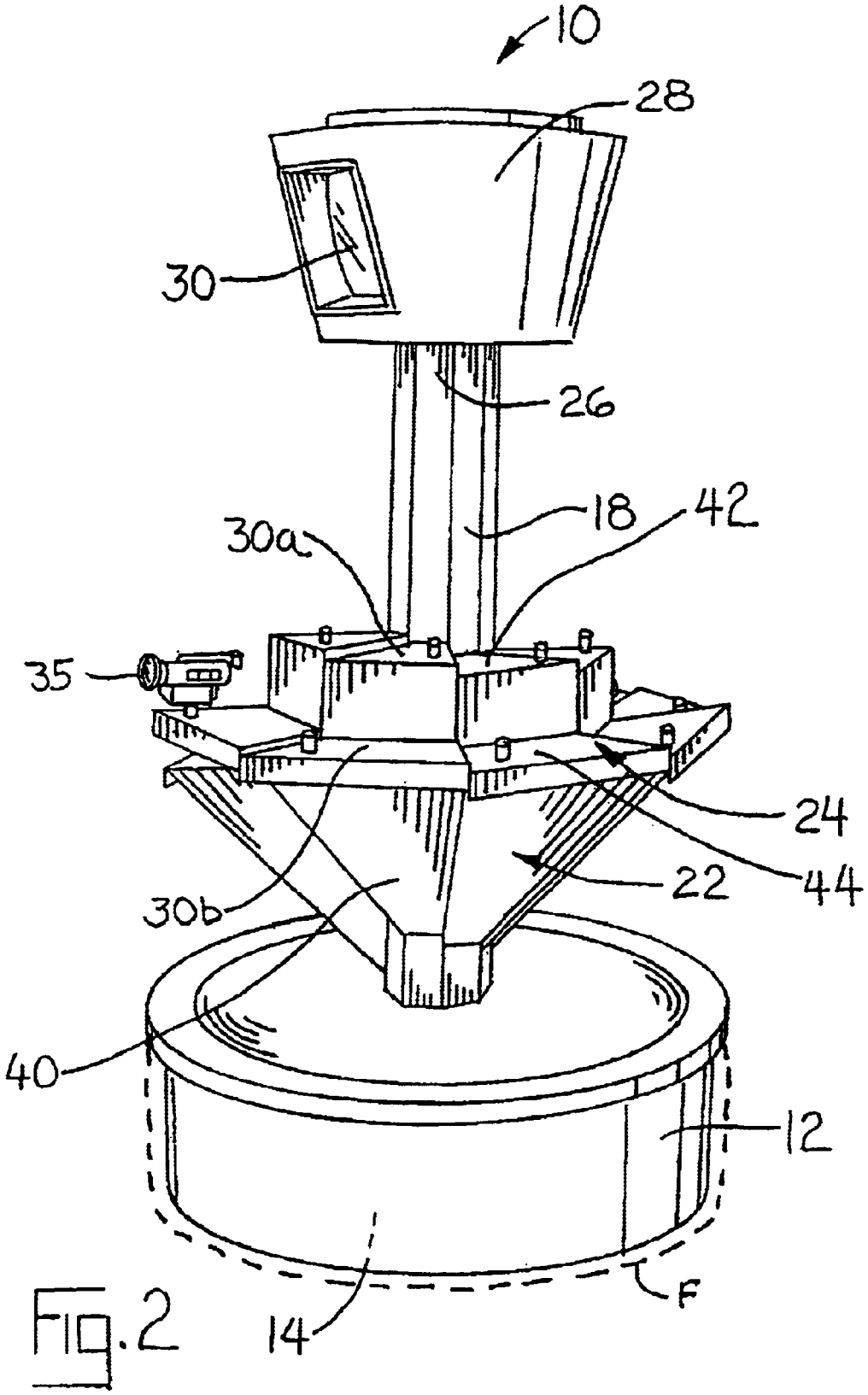
FIG. 2 is a perspective view of a vertical merchandise display unit for camcorders in accordance with the present invention.

In the illustrations given, and with reference first to FIGS. 1 and 2, the reference numeral 10 designates generally a vertical merchandise display unit in accordance with the present invention. It will become apparent from the description which follows that the unit 10 illustrated in FIG. 1 is designed specifically for digital cameras whereas the unit 10 illustrated in FIG. 2 is designed specifically for camcorders. In this connection, the components which are common to both FIG. 1 and FIG. 2 are designated with the same reference numeral as will be apparent from the description which follows below.

Figure 3:
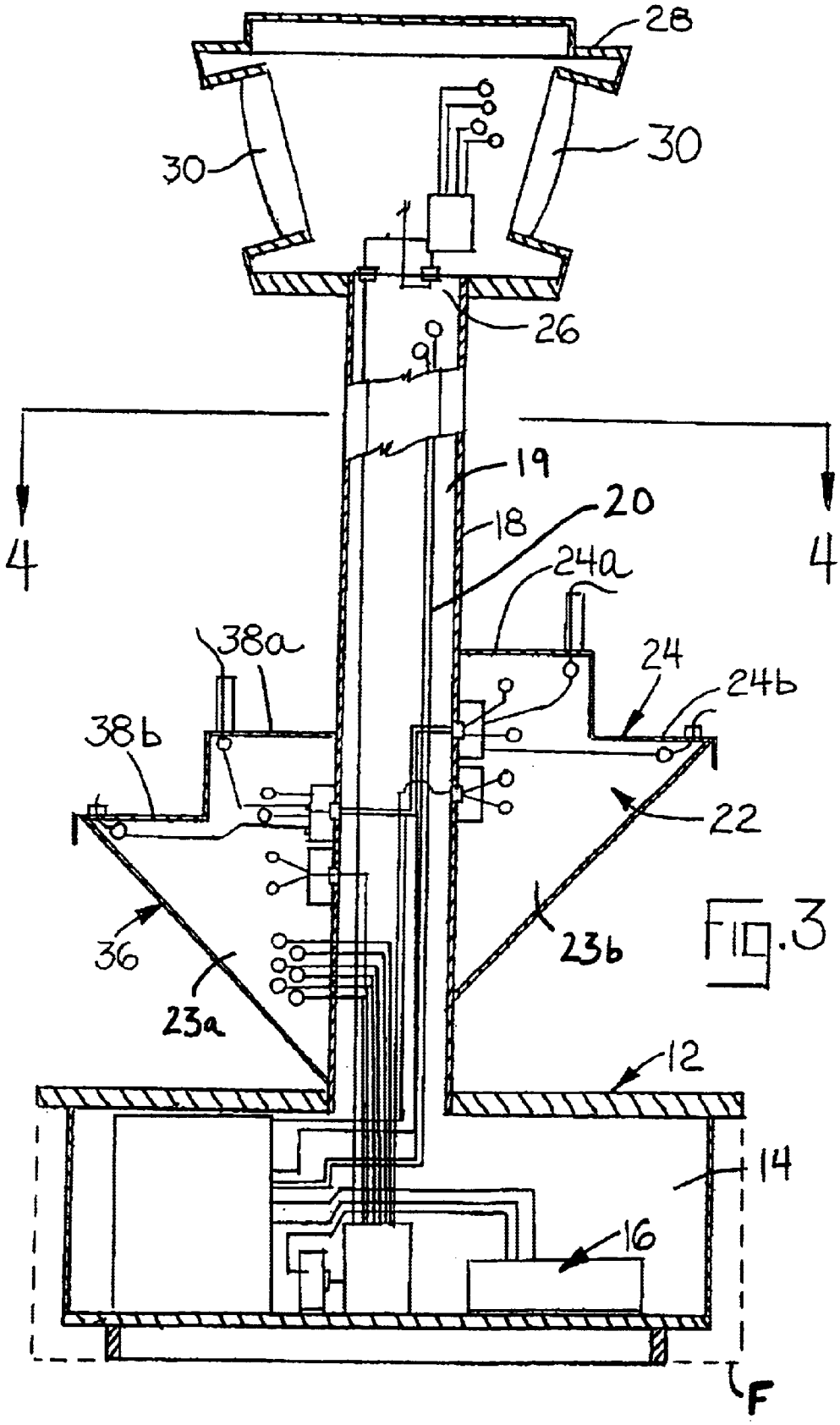
FIG. 3 is a cross-sectional view taken along a vertical axis of the vertical merchandise display unit illustrated in FIG. 2.

Referring to FIGS. 1–3, the vertical merchandise display unit 10 includes a base 12 defining a storage compartment 14 for operating equipment 16 (viewable in FIG. 3 only) related to a product to be displayed on the unit 10 for viewing and manipulation by a potential purchaser of the product. It will also be seen that the unit 10 includes a riser or hollow pole 18 mounted to and extending generally vertically upwardly from the base 12 to provide a chase 19 for wiring 20 (FIG. 3) from the operating equipment 16 in the storage compartment 14 through the riser or hollow pole 18. The operating equipment 16 may include, by way of example rather than limitation, one or more of an alarm, a computer, and or digital video disc (DVD) player, depending on the type of product on the display. A plurality of product support arms generally designated 22 each extend radially outwardly from the riser or hollow pole 18 above the base 12 and have at least one generally horizontal surface generally designated 24 for displaying at least one product thereon. It will also be seen that the base 12 is generally cylindrical in shape and has a generally circular cross-section in order to provide a radial footprint F (shown in phantom in FIGS. 1 and 2) generally commensurate with the radial extent of the product support arms 22. With this arrangement, the riser or hollow pole 18 has an upper end 26 which supports an inverted generally frustoconical monitor pod 28 having at least one monitor 30 disposed therein for a purpose to be described in greater detail below.

Figure 4:
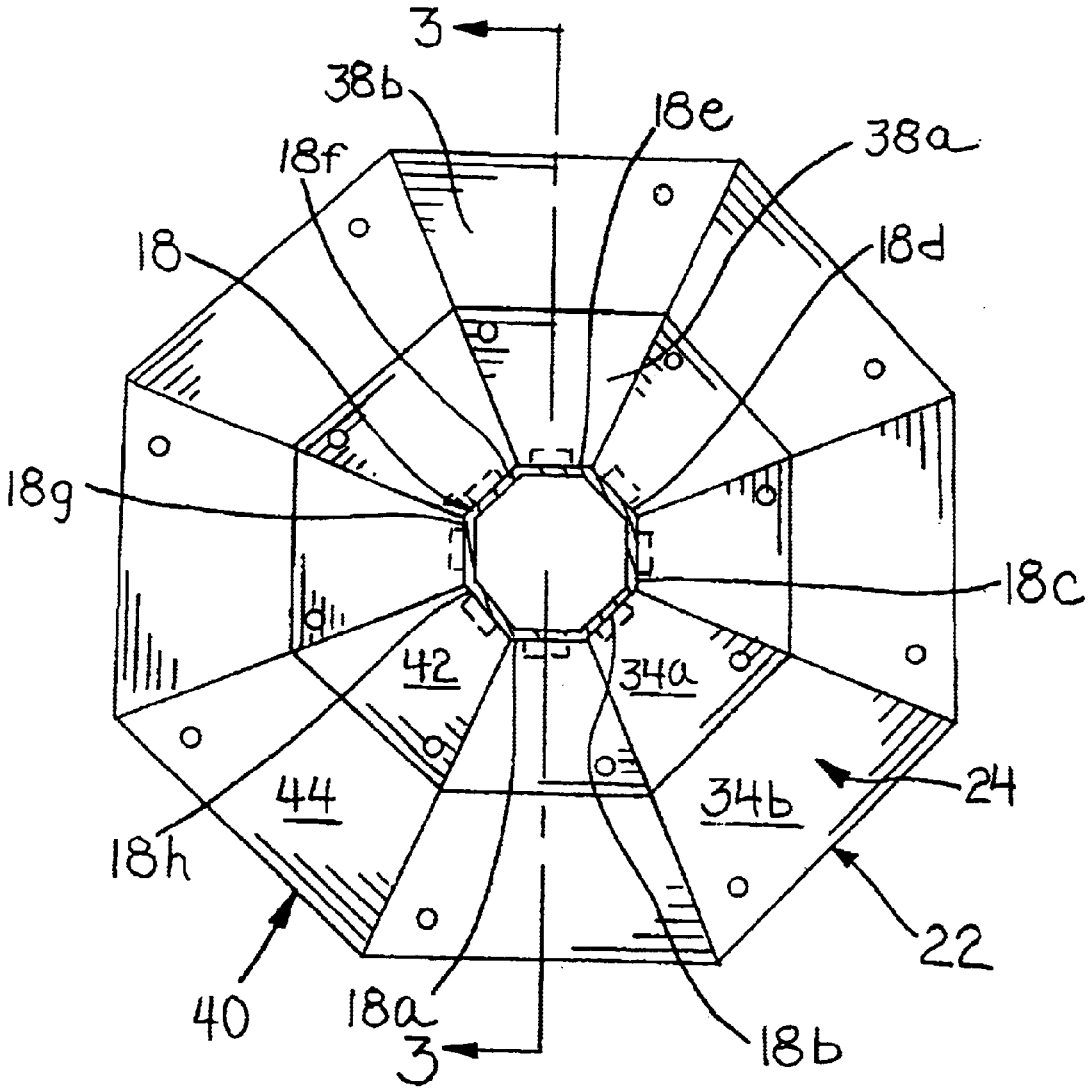
FIG. 4 is a cross-sectional view taken transverse to the vertical axis of the vertical merchandise display unit along the line 4—4 of FIG. 3.

As best shown in FIGS. 1, 2, and 4, the riser or hollow pole 18 is generally octagonal in cross-section to provide flat surfaces 18*a* through 18*h* (FIG. 4) for securing the product support arms thereto. It will be seen that each of the products support arms 22 in both the digital camera embodiment of FIG. 1 and the camcorder embodiment of FIG. 2 comprise separate hollow pods 23*a*, 23*b* having generally inverted pyramidal shapes (see FIG. 3). Still additionally, the product support arms 22 will be seen to have the product supporting surfaces generally designated 24 and suitably positioned at more than one vertical distance above the base 12.

Referring specifically to FIG. 1, each of the product support arms 22 includes a pair of generally horizontal surfaces 30*a* and 30*b* for displaying digital cameras 32 generally at a first level (on the horizontal surface 30*a*) adjacent the riser or hollow pole 18 and generally at a second, lower level (on the horizontal surface 30*b*) radially outwardly of the riser or hollow pole. Referring specifically to FIG. 2, the product support arms 22 include generally horizontal surfaces 34*a* and 34*b* for displaying camcorders 35 generally at a first level (on the horizontal surface 34*a*) adjacent the riser or hollow pole 18 and generally at a second, lower level (on the horizontal surface 34*b*) radially outwardly of the riser or hollow pole 18.

With the structures described in detail hereinabove, the vertical merchandise display unit 10 can be formed to have, by way of example, a diameter of 4' and a height of 8'. This means that the radial footprint for the vertical merchandise display unit 10 takes up only approximately 12½ square feet in contrast to the 28 square feet occupied by conventional 14' wide by 2' deep display units for digital cameras and camcorders. Therefore, the vertical merchandise display units 10 occupy less than half of the floor space of conventional displays while at the same time being highly attractive and user friendly.

Figure 6:
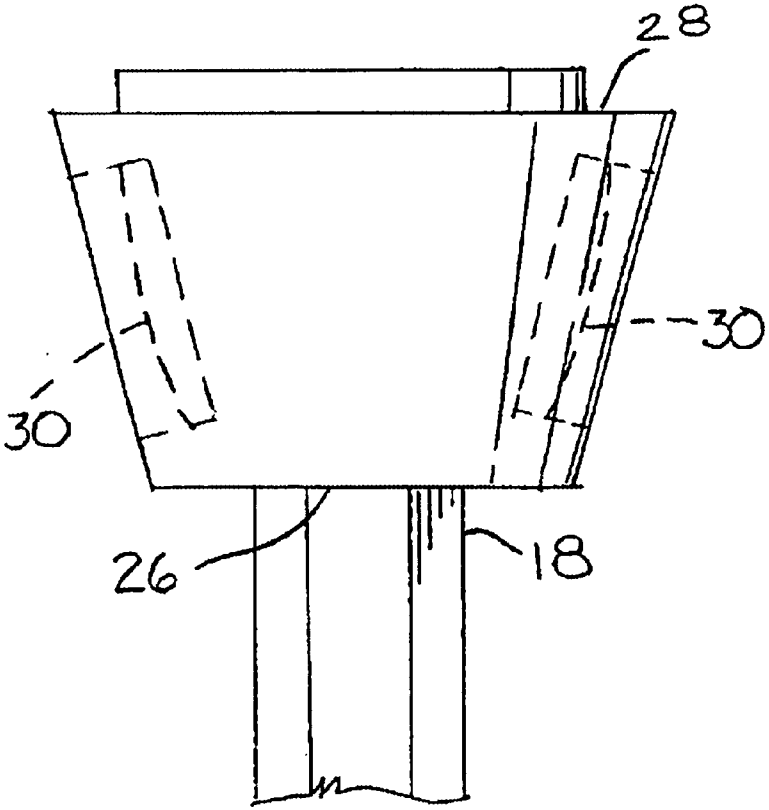
FIG. 6 is a side elevational view of a monitor pod for the vertical merchandise display unit illustrated in FIG. 2.
Figure 5:
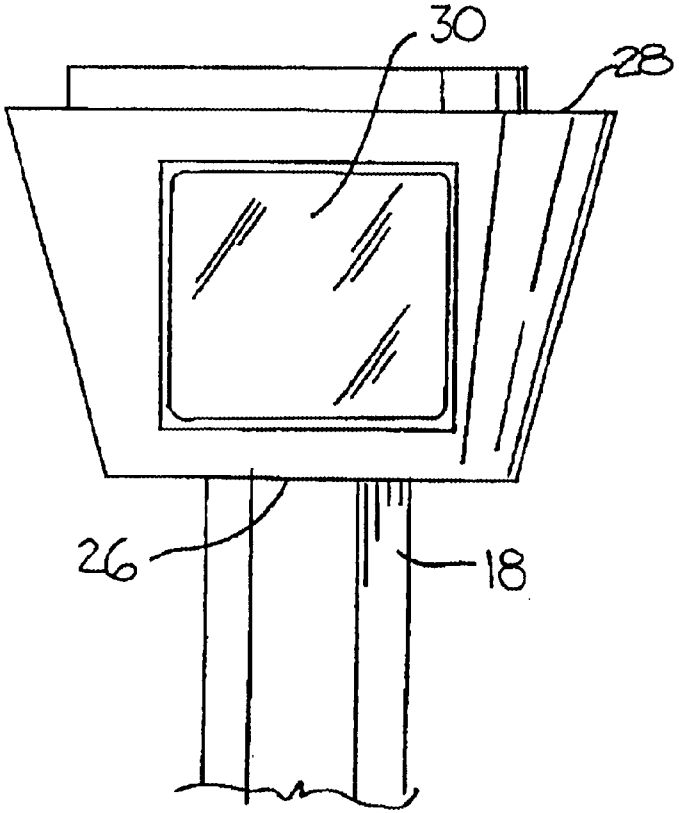
FIG. 5 is a front elevational view of a monitor pod for the vertical merchandise display unit illustrated in FIG. 2.

With regard to the height of the vertical merchandise display units 10, it is purposely selected to place the monitor so that it is located at a distance well above the average person's head. It will be seen from FIGS. 3 and 6 that the monitor 30 is preferably angled downwardly so even those with disabilities can see the display contained thereon. Nevertheless, the height of the monitor 30 discourages customers from watching for an elongated period of time because of the need to bend the neck. In the case of a digital camera display, the vertical merchandise display unit 10 will contain a single monitor 30 (FIG. 5) whereas a pair of monitors 30 (FIG. 6) are provided in the case of displaying camcorders.

As will be appreciated from FIG. 1, the product support arms generally designated 22 take the form of eight stepped inverted generally pyramidal sections 36 for the digital camera display embodiment. The generally pyramidal sections 36 each have an upper surface 38*a* adjacent the riser or hollow pole 18 and a lower surface 38*b* radially outwardly from the riser or hollow pole. As shown, the generally horizontal surfaces 38*a* and 38*b* are each adapted to carry two digital cameras giving the entire vertical merchandise display unit 10 the capacity to hold a total of 32 digital cameras.

Referring to FIG. 2, the product support arms generally designated 22 take the form of eight separate inverted generally pyramidal sections 40 for the camcorder display embodiment. The generally pyramidal sections 40 each have a generally horizontal surface 42 at a first level adjacent the riser or hollow pole 18 and a second generally horizontal surface 44 at a second, lower level located radially outwardly of the riser or hollow pole 18. With this arrangement, the eight separate inverted generally pyramidal sections 40 are capable of supporting a total of sixteen camcorders, i.e., one on each of the generally horizontal surfaces 42 and 44.

By also referring to FIGS. 1 and 2, it will be appreciated that there is a slightly staggered relationship between the respective ones of the generally horizontal surfaces 38*a* and the respective ones of the generally horizontal surfaces 38*b* in the case of the generally pyramidal sections 36 and, similarly, there is a slight staggering of the respective ones of the generally horizontal surfaces 42 and the generally horizontal surfaces 44 in the case of the generally pyramidal sections 40. The respective ones of the generally pyramidal sections 36 (in the case of the digital camera display) and the alternating generally pyramidal sections 40 (in the case of the camcorder display) can advantageously be separate hollow pods to be secured to the flat surfaces 18*a*–18*h* (FIG. 4) of the respective risers or hollow poles 18. Advantageously, the staggering of the generally horizontal surfaces 38*a*, 38*b* relative to the generally horizontal surfaces 30*a*, 30*b* (in the case of the generally pyramidal sections 36) and 42, 44 relative to the generally horizontal surfaces 30*a*, 30*b* (in the case of the generally pyramidal sections 40) provides a certain visual interest to potential customers due to the slight staggering of digital cameras and camcorders that are disposed on the same general level in the two-tier arrangement of product that is being displayed for viewing and manipulation by those who are passing by the display.

While not relating specifically to this invention, the operating equipment 16 can take many forms depending upon the objectives of the retailer and the products at issue. For instance, in the case of either digital cameras or camcorders, it is possible to provide a DVD player that continuously plays an audio and video advertising piece on the monitor(s) 30 that relates to the products and draws consumer attention to the vertical merchandise display unit 10. In addition, the digital cameras and camcorders can be rendered operable by appropriate switching devices to permit the consumer to test the product by viewing captured images on the monitor(s) 30.

Figure 7:
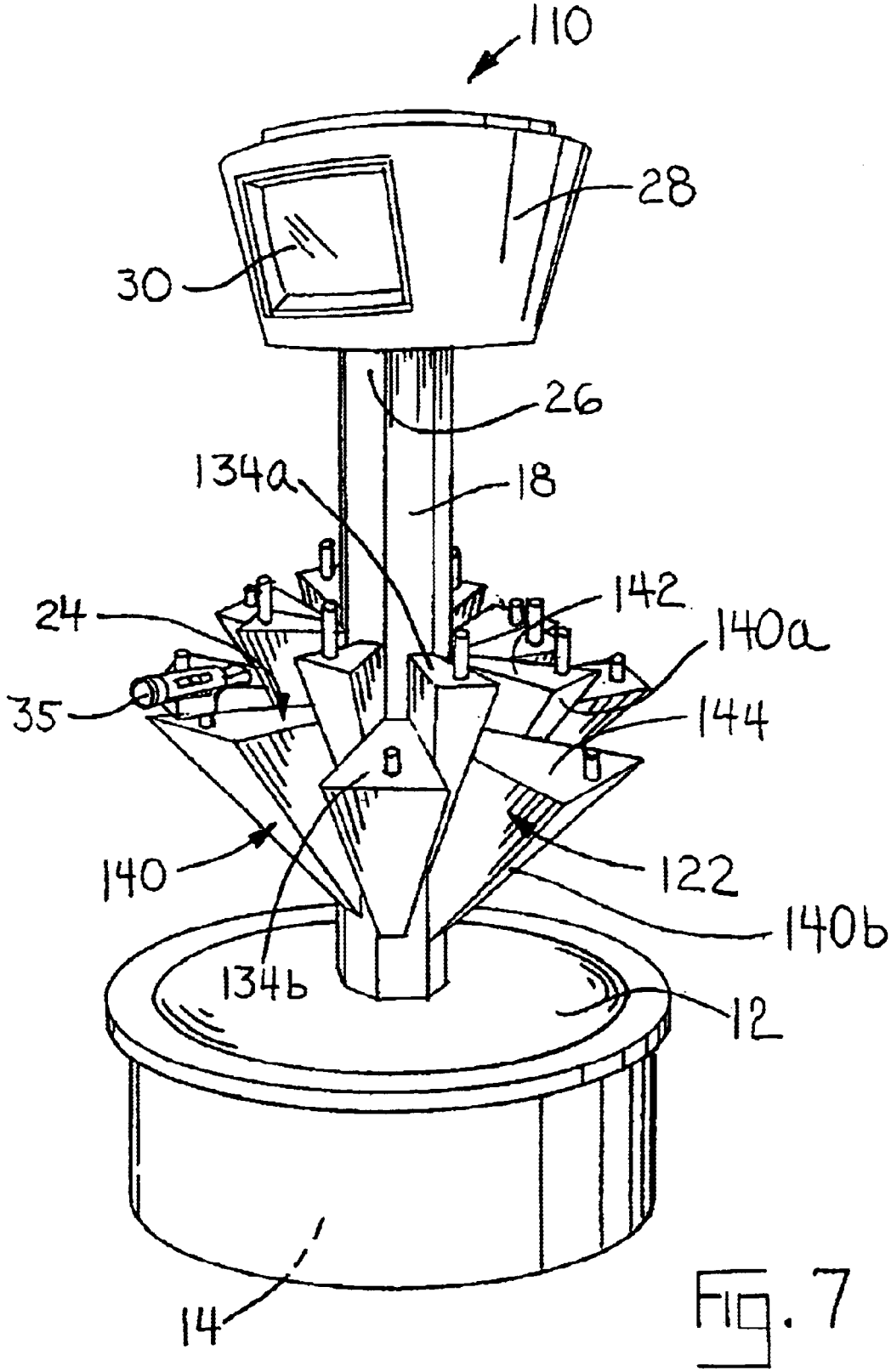
FIG. 7 is a perspective view of a vertical merchandise display unit constructed in accordance with the teachings of another disclosed embodiment of the invention.

Referring now to the alternate embodiment of FIG. 7, the vertical merchandise display unit 110 shown therein includes product support arms generally designated 122 which take the form of sixteen separate inverted pyramidal sections 140. The generally pyramidal sections 140 include alternating sections 140*a* and 140*b*, with the sections 140*a* having a generally horizontal surface 142 at a first level adjacent the hollow pole 18, and with the sections 140*b* having a generally horizontal surface 144 at a second lower level located radially outwardly of the hollow pole 18. With this arrangement, sixteen inverted pyramidal sections 140*b*, comprised of eight sections 140*a* and eight sections 140*b*, are capable of supporting a total of sixteen camcorders 35 (i.e., one on each of the generally horizontal surfaces 142 and 144). It will be noted that the generally horizontal surface 142 is vertically staggered relative to an adjacent generally horizontal surface 134*a*, while the generally horizontal surface 144 is vertically staggered relative to an adjacent generally horizontal surface 134*b*. This staggered arrangement may continue around the pole 18.

While in the foregoing there have been set forth preferred embodiments of the invention, it will be appreciated that the details herein given may be varied by those skilled in the art without departing from the true spirit and scope of the appended claims.

What is claimed is:

1. A vertical merchandise display unit, comprising:

a base defining an enclosure for equipment;

a pole mounted to and extending generally vertically upwardly from the base, the pole defining an enclosed channel communicating with the base to provide a chase for wiring through the pole;

a plurality of product support arms extending radially outwardly from the pole above the base and each arm having a product support surface for displaying at least one product thereon, wherein the product support surfaces collectively extend substantially around the periphery of the pole; and a monitor supported by the pole above the product support arms.

2. The vertical merchandise display unit of claim 1, wherein the base is generally circular in cross-section and has a radial footprint generally commensurate with the radially outwardly extending arms.

3. The vertical merchandise display unit of claim 1, wherein the base is generally cylindrical in shape and has a radial footprint generally commensurate with the radially outwardly extending arms.

4. The vertical merchandise display unit of claim 1, wherein the pole has a plurality of generally vertically extending flat surfaces for securing the product support arms thereto.

5. The vertical merchandise display unit of claim 1, wherein the pole has an upper end supporting an inverted generally frustoconical monitor pod having the monitor disposed therewithin.

6. The vertical merchandise display unit of claim 1, wherein each of the product support arms comprises a separate hollow pod having a generally inverted pyramidal shape.

7. The vertical merchandise display unit of claim 1, wherein at least one of the product support arms includes product support surfaces positioned at more than one vertical distance above the base.

8. The vertical merchandise display unit of claim 1, wherein at least one of the product support arms is hollow.

9. The vertical merchandise display unit of claim 1, wherein the product support surfaces are generally wedge-shaped.

10. The vertical merchandise display unit of claim 1, wherein at least two of the product support surfaces are positioned at different vertical distances above the base.

11. A vertical merchandise display unit, comprising:

a base defining a storage compartment for operating equipment related to a product to be displayed on the unit for viewing and manipulation by a potential purchaser of the product;

a hollow pole mounted to and extending generally vertically upwardly from the base to provide a chase for wiring from the operating equipment in the storage compartment through the hollow pole; and a plurality of product support arms each extending radially outwardly from the hollow pole above the base and having a generally horizontal surface for displaying at least one product thereon;

the base being generally cylindrical in shape and having a radial footprint generally commensurate with the radial extent of the radially outwardly extending product support arms;

the hollow pole having an upper end supporting an inverted generally frustoconical monitor pod having at least one monitor disposed therewithin.

12. The vertical merchandise display unit of claim 11 wherein the hollow pole is generally octagonal in cross-section to provide flat surfaces for securing the product support arms thereto.

13. The vertical merchandise display unit of claim 11 wherein each of the product support arms comprises a separate hollow pod having a generally inverted pyramidal shape.

14. The vertical merchandise display unit of claim 11 wherein the product support arms include product supporting surfaces positioned at more than one vertical distance above the base.

15. The vertical merchandise display unit of claim 11 wherein each of the product support arms includes a pair of generally horizontal surfaces for displaying digital cameras at a first level adjacent the hollow pole and at a second, lower level radially outwardly of the hollow pole.

16. The vertical merchandise display unit of claim 11 wherein alternating ones of the product support arms include generally horizontal surfaces for displaying camcorders at a first level adjacent the hollow pole and at a second, lower level radially outwardly of the hollow pole.

17. A vertical merchandise display unit, comprising:

a base;

a riser extending generally vertically upwardly from the base;

a plurality of product support arms each attached to and extending radially outwardly from the riser above the base, wherein each of the product support arms comprises a separate hollow pod having a generally inverted pyramidal shape; and a monitor supported by the riser above the product support arms.

18. The vertical merchandise display unit of claim 17, wherein the base is generally circular in cross-section and has a radial footprint generally commensurate with the radially outwardly extending arms.

19. The vertical merchandise display unit of claim 17 wherein the base comprises a storage compartment for operating equipment related to a product to be supported on the arms.

20. The vertical merchandise display unit of claim 17 wherein the riser is a hollow pole mounted to the base to provide a chase for wiring from the base to the product support arms and the monitor.

21. The vertical merchandise display unit of claim 17 wherein the riser is a hollow pole mounted to the base and having a plurality of flat surfaces for securing the product support arms thereto.

22. The vertical merchandise display unit of claim 17 wherein the riser is a hollow pole having an upper end supporting a monitor pod having the monitor disposed therewithin.

23. The vertical merchandise display unit of claim 17 wherein each of the product support arms has a product supporting surface for displaying at least one product thereon.

24. The vertical merchandise display unit of claim 17 wherein the product support arms include product supporting surfaces positioned at more than one vertical distance above the base.

* * * * *